US006027406A

United States Patent [19]

Yazici

[11] Patent Number: 6,027,406

[45] Date of Patent: Feb. 22, 2000

[54] CENTRIFUGAL FAN UNIT WITH VERTICAL ROTATION AXIS

[75] Inventor: Muammar Yazici, Etobicoke, Canada

[73] Assignee: Air Handling Engineering Ltd., Buffalo, N.Y.

[21] Appl. No.: 09/045,398

[22] Filed: Mar. 20, 1998

[51] Int. Cl.[7] ..... F24F 7/007

[52] U.S. Cl. ..... 454/338; 454/355; 454/906; 181/224; 181/225; 55/467; 55/471

[58] Field of Search ..... 454/355, 906, 454/338; 55/385.2, 467, 471; 181/224, 225

[56] References Cited

U.S. PATENT DOCUMENTS

| | | | |
|---|---|---|---|
| 2,318,393 | 5/1943 | Honerkamp et al. | 62/129 |
| 2,363,839 | 11/1944 | Demuth | 98/33 |
| 3,211,077 | 10/1965 | Kramer, Jr. | 998/36 |
| 3,583,175 | 6/1971 | Eubank | 62/326 |
| 3,748,997 | 7/1973 | Dean, Jr. et al. | 98/33 |
| 3,776,122 | 12/1973 | Julian | 454/355 |
| 3,840,067 | 10/1974 | Bos | 165/1 |
| 3,866,668 | 2/1975 | Doerner | 165/1 |
| 3,960,063 | 6/1976 | Siemes et al. | 454/355 |
| 3,996,314 | 12/1976 | Lakmaker | 261/30 |
| 4,232,729 | 11/1980 | Ingram et al. | 165/95 |
| 4,295,416 | 10/1981 | Gorchev et al. | 98/33 |
| 5,445,218 | 8/1995 | Nieh | 165/125 |

*Primary Examiner*—Harold Joyce
*Assistant Examiner*—Derek S. Boles
*Attorney, Agent, or Firm*—Gifford, Krass, Groh, Sprinkle, Anderson & Citkowski, P.C.

[57] ABSTRACT

A centrifugal fan system for a building, including a centrifugal fan mounted for rotation about a vertical axis and having a bottom inlet. The fan is mounted in a movable housing having a fan chamber and an air outlet arranged in a side thereof. Wheels are mounted on both sides of the fan housing and engage two elongate track members, that extend horizontally and are mounted on a suitable supporting structure. Thus, the fan and its housing can be moved horizontally away from the top of an input flow concentrator. The housing has an internal, perforated scroll-shaped wall and vertical external walls. Sound insulation is located between the scroll-wall and the external walls. An electrical motor is mounted on the side of the housing and is connected to drive the fan.

21 Claims, 4 Drawing Sheets

CENTRIFUGAL FAN UNIT WITH VERTICAL ROTATION AXIS

BACKGROUND OF THE INVENTION

This invention relates to centrifugal fan systems, particularly such systems intended for use in buildings and other large structures.

Centrifugal fan systems are well known for a variety of applications and have been used in the past, for example, to provide fresh and/or heated air to a building by means of a plenum system. A centrifugal fan generally has a number of blades evenly distributed about a central rotation axis, these blades being mounted on two or more metal plates. The fan has a central inlet opening while the outlet of the fan is circumferential. The fan can be rotated by means of a central drive shaft which in turn is rotated by a suitable electrical motor.

U.S. Pat. No. 3,748,997 issued Jul. 31, 1973 to Tempmaster Corporation describes a penthouse type air conditioning unit that includes an acoustically insulated centrifugal fan that is separated from the fan motor. The fan impeller rotates about a horizontal axis in a plenum type chamber. The fan is supported by means of a framework which includes vertical uprights and compression vibration isolators support the entire fan assembly. The pressurized air from the fan flows downwardly through an outlet in the bottom of the fan compartment.

It is also known to employ an axial-type fan in an air distribution system for a building. An air distribution system using such a fan is taught in U.S. Pat. No. 4,295,416 issued Oct. 20, 1981 to Mitco Corporation. This patent teaches the use of an input flow concentrator and integral silencer disposed below the fan in a mixing plenum. The combined concentrator and silencer establishes a substantially axial symmetrical flow path for air from the plenum to an output port. The fan is coupled to this output port to drive the air to the main duct for distribution. A bank of heat exchange coils can be disposed adjacent to the input port of the concentrator/silencer.

It is an object of the present invention to provide a relatively inexpensive yet efficient centrifugal fan system to supply air to a building or other large structure.

It is a further object of the present invention to provide such a centrifugal fan system wherein the fan and the fan housing can readily be moved in order to provide access thereto for maintenance or repairs.

It is another object of the present invention to provide a relatively inexpensive centrifugal fan system for supplying air to a building, which system is reasonably efficient due to the use of an internal scroll-shaped wall extending around the fan and forming a plenum fan chamber, while at the same time the fan is reasonably quiet in its operation due to the use of sound insulating material around the scroll-shaped wall.

SUMMARY OF THE INVENTION

According to one aspect of the invention, a centrifugal fan apparatus for a building or other large structure comprises a linear movable fan housing having a fan chamber and an air outlet in a vertical sidewall thereof and a centrifugal fan member mounted in this housing for rotation in the chamber about a substantially vertical axis. The apparatus also includes an input flow concentrator having a concentrator input port and sidewalls establishing an airflow path from the input port to an output port having an output axis. The airflow path changes from a substantially radial airflow path at the input port to a substantially vertical and axial airflow path at the output port. The fan member has a number of blades and a bottom air inlet. The fan housing has a scroll-shaped wall defining member defining the chamber and is mounted above the flow concentrator during use thereof. Wheels are rotatably mounted on the fan housing and support the housing and the fan member. A track system guides linear horizontal movement of the fan housing and fan member and supports same. This track system includes track members adapted for mounting in a fixed position on a supporting structure. The wheels are adapted for rolling engagement with the track members so that the fan housing and fan member can be moved horizontally away from an operating position when required.

According to a further aspect of the invention, a centrifugal fan unit for supplying relatively large quantities of air to a building or other large structure, includes the aforementioned concentrator and a fan housing mounted above the flow concentrator and having a fan chamber and an air outlet in a vertically extending sidewall thereof. This housing includes an internal, perforated scroll-shaped wall defining a vertically extending peripheral wall of the chamber. The housing also has vertically extending external walls arranged around the scroll-shaped wall. There is sound insulating material positioned between the scroll-shaped wall and the external walls. A centrifugal fan member is mounted in the housing for rotation in the fan chamber about a substantially vertical axis. The fan member has a number of blades and a bottom air inlet. The vertical axis of the fan member and the output axis of the concentrator are substantially coaxial.

Preferably the fan housing has an insulated top wall covering a top of the fan chamber. This top wall is rigidly attached to the scroll-shaped wall and the vertically extending external walls.

Further features and advantages of the fan system will become apparent from the following detailed description taken in conjunction with the accompanying drawings.

BRIEF DESCRIPTION OF TEE DRAWINGS

DETAILED DESCRIPTION OF PREFERRED EMBODIMENTS

In the accompanying drawings, the same reference numbers are used to designate the same components and features in the illustrated centrifugal fan systems.

Figure 1:
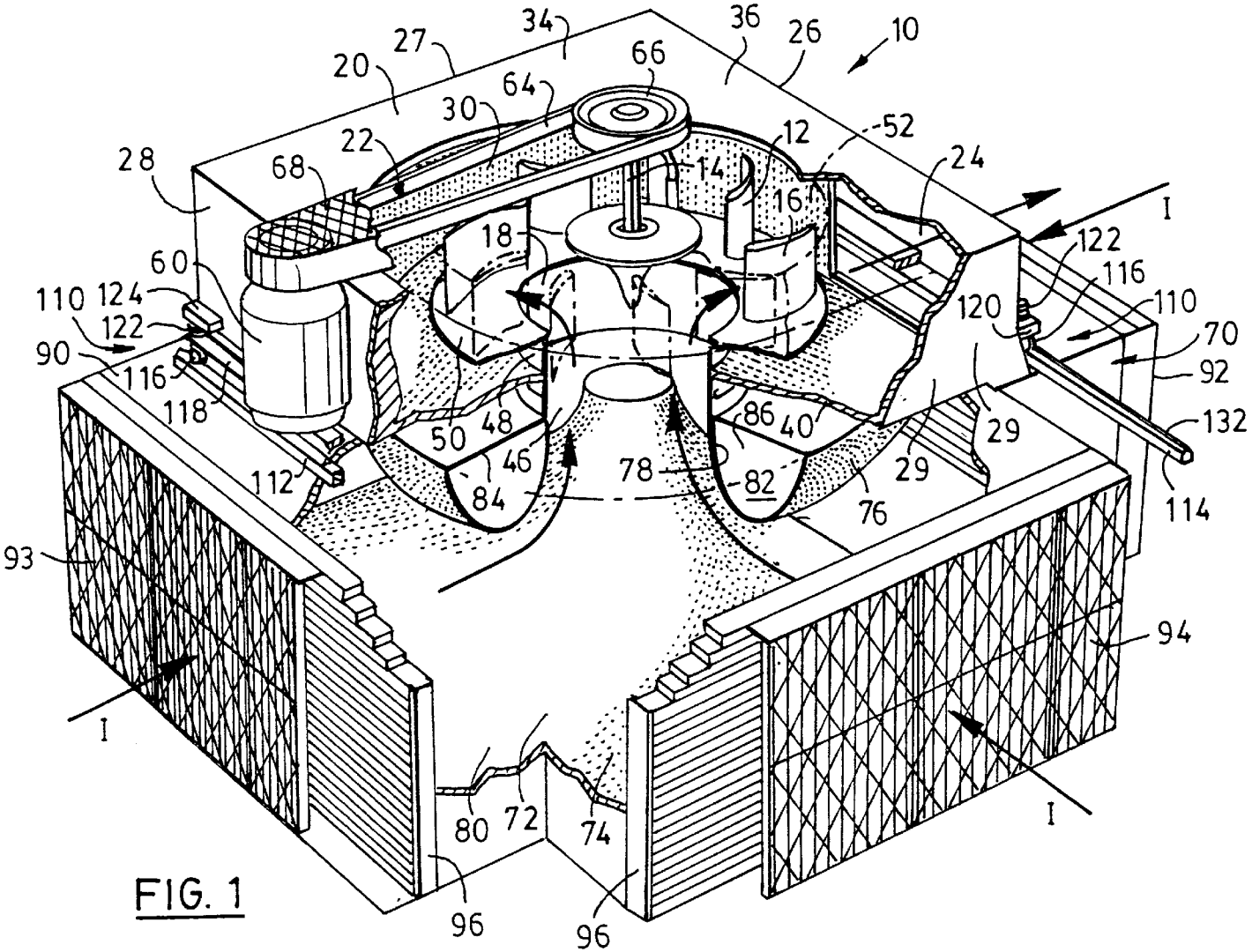
FIG. 1 is a perspective schematic view of a centrifugal fan system constructed in accordance with the invention, with portions of the system broken away for purposes of illustration.

Turning to FIG. 1, the illustrated centrifugal fan system 10 for a building or other large structure includes a centrifugal fan 12 mounted for rotation about a substantially vertical axis, this axis being defined by the central axis of a drive shaft 14. The fan 12 has a number of blades 16 which preferably have an airfoil shape and are curved in a horizontal plane. The fan has a bottom inlet 18 which is preferably circular.

The centrifugal fan 12 is rotatably mounted in a movable fan housing 20 which forms a fan chamber 22. An air outlet 24 for the pressurized air is arranged in a side of the housing 20. As illustrated, the outlet 24 is located in one of four vertical sides 26 to 29 of the housing. The sides 26 to 29 are preferably made of sheet steel or other suitable metal and they form vertically extending external walls of the housing. These walls surround an internal, perforated, scroll-shaped wall 30 defining a vertically extending, peripheral wall of the fan chamber 22. The wall 30 is covered with a large number of evenly distributed holes which, when used in association with suitable sound insulating material effectively reduces the level of sound emitted by the fan system. Sound insulating material is arranged between the wall 30 and the external walls 26 to 29. A suitable form of known insulation is fiberglass batt insulation.

Figure 4:
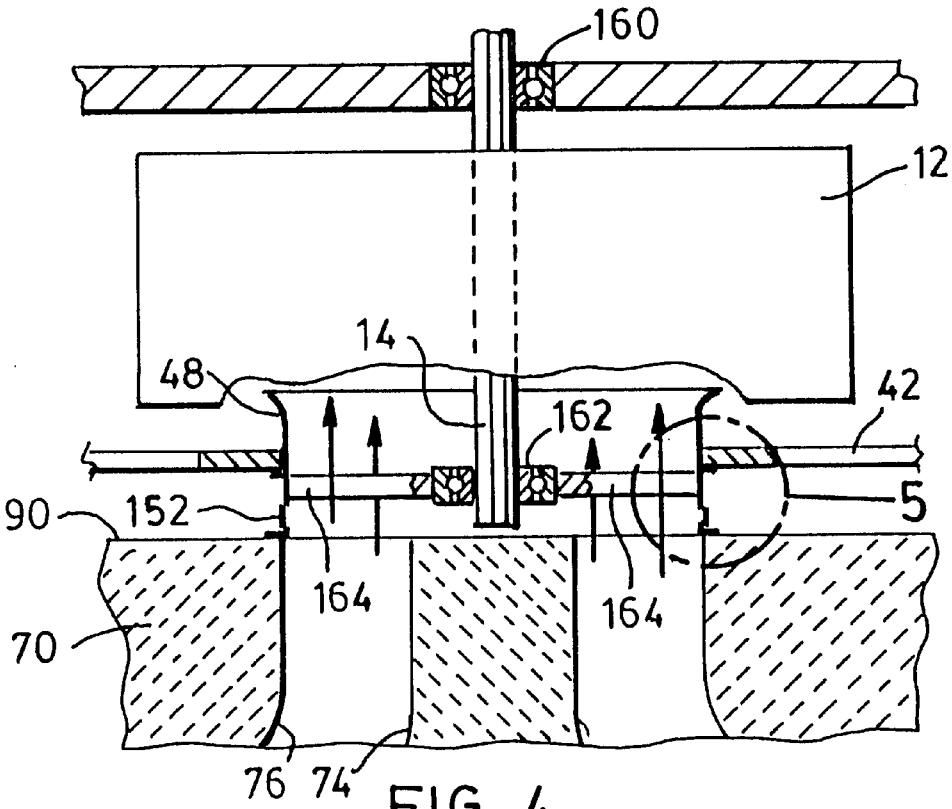
FIG. 4 is a cross-sectional elevation taken through the central axis of the fan showing how the fan housing is connected to an inlet silencer unit.

The fan housing 20 includes a horizontally extending top wall 34 which defines a top of the fan chamber 22 and is rigidly connected to the vertically extending external walls 26 to 29. This top wall is also rigidly connected to the scroll-shaped wall 30. It will be understood that these walls of the housing can be welded together. Preferably the top wall 34 itself is insulated and is made up of an external sheet metal panel 36 and an internal perforated metal panel 38 with sound insulation being sandwiched between external panel 36 and the internal panel 38. The aforementioned drive shaft 14 extends through the top wall 34 and suitable tapered thrust bearings (not shown) can be used to mount the drive shaft 14 in the top wall. The thrust bearings, which are known per se, are chosen to rotatably support both the shaft and the attached fan 12. The shaft 14 can either be supported by two thrust bearings mounted in or on the top wall to support the shaft in a cantilever fashion or it can be rotatably mounted as shown in FIG. 4 and as described in detail below.

The illustrated preferred housing 20 also includes an insulated bottom wall 40 comprising a sheet metal external panel 42 and a perforated, internal sheet metal panel 44. Again, sound insulating material is sandwiched between the panel 42 and the panel 44. The bottom wall 42 has a centrally located, circular air inlet opening 46. In the illustrated preferred embodiment, this opening is defined by a cylindrical extension 48 which is attached to the bottom wall 40. This extension extends up to an annular bottom plate 50 of the fan 12.

It will be understood that each of the blades 16 is connected to the bottom plate 50. There is also a circular top plate 52 (shown in outline only in FIG. 1) forming the top of the fan 12. The plate 52 can be a solid, unbroken plate except for a possible central hole to receive the drive shaft. It will be understood that the air inlet 46 in the bottom wall is aligned with the bottom air inlet of the fan member 12.

Motor means are provided for rotating the fan 12. In the illustrated preferred embodiment, this motor means includes a suitable electrical motor 60 which is mounted to the sidewall 28 of the fan housing by means of a connecting member 62 or brackets. As indicated, the fan housing 20 is movable in the horizontal direction and the motor 60 moves with the housing. In the illustrated system, the motor 60 is connected to the fan by means of a flexible drive belt 64 which extends around a drive pulley 66 fixedly connected to an outer end of the drive shaft 14. Preferably a protective metal shield 68 extends across the top of the drive belt and around the sides thereof. Instead of using the drive belt 64 and the pulley 66, it is also possible to connect the electrical motor directly to the drive shaft 14, in which case the motor would be rigidly mounted in a suitable manner on the top of the fan housing.

The illustrated preferred fan system includes an input flow concentrator and integral silencer indicated generally at 70. This concentrator/silencer is referred to hereinafter as an input silencer and it has a concentrator input port 72 and sidewalls 74 and 76 establishing an airflow path from the input port to an output port located at 78, which port has an output axis in the center thereof. Due to the shape of the sidewalls 74, 76, the airflow path changes from a substantially radial airflow path at the input port 72, as indicated by the arrows I to a substantially vertical and axial airflow path at the output port. An input silencer of this general type is shown and described in the aforementioned U.S. Pat. No. 4,295,416, the disclosure of which is incorporated herein by reference.

The illustrated preferred input silencer includes an inner silencer section 80 having a generally conical shape and an outer silencer section 82, both these sections being coaxial with the output axis and being formed at least partially by the sidewalls 74,76. Thus, the sidewall 74 is generally conical in shape and forms an upper surface of the inner silencer section. In a known manner, the sidewall 74 is made with perforated sheet metal and sound insulating material is packed within the section 80 behind the sidewall. The illustrated preferred outer silencer section 82 is an annulus, forming and defining the output port. This annulus around its circumference is substantially semi-circular in transverse cross-section as illustrated in FIG. 1, having a flat top wall 84. The side wall 76 forms a rounded bottom and vertical sides of the annulus and is preferably perforated, as shown. The interior of the annulus is filled with a suitable, standard sound insulation material such as fiberglass indicated at 86. The annulus or inner section 80 can be rigidly mounted to a rigid, preferably insulated, top wall 90 of the input silencer.

Figure 2:
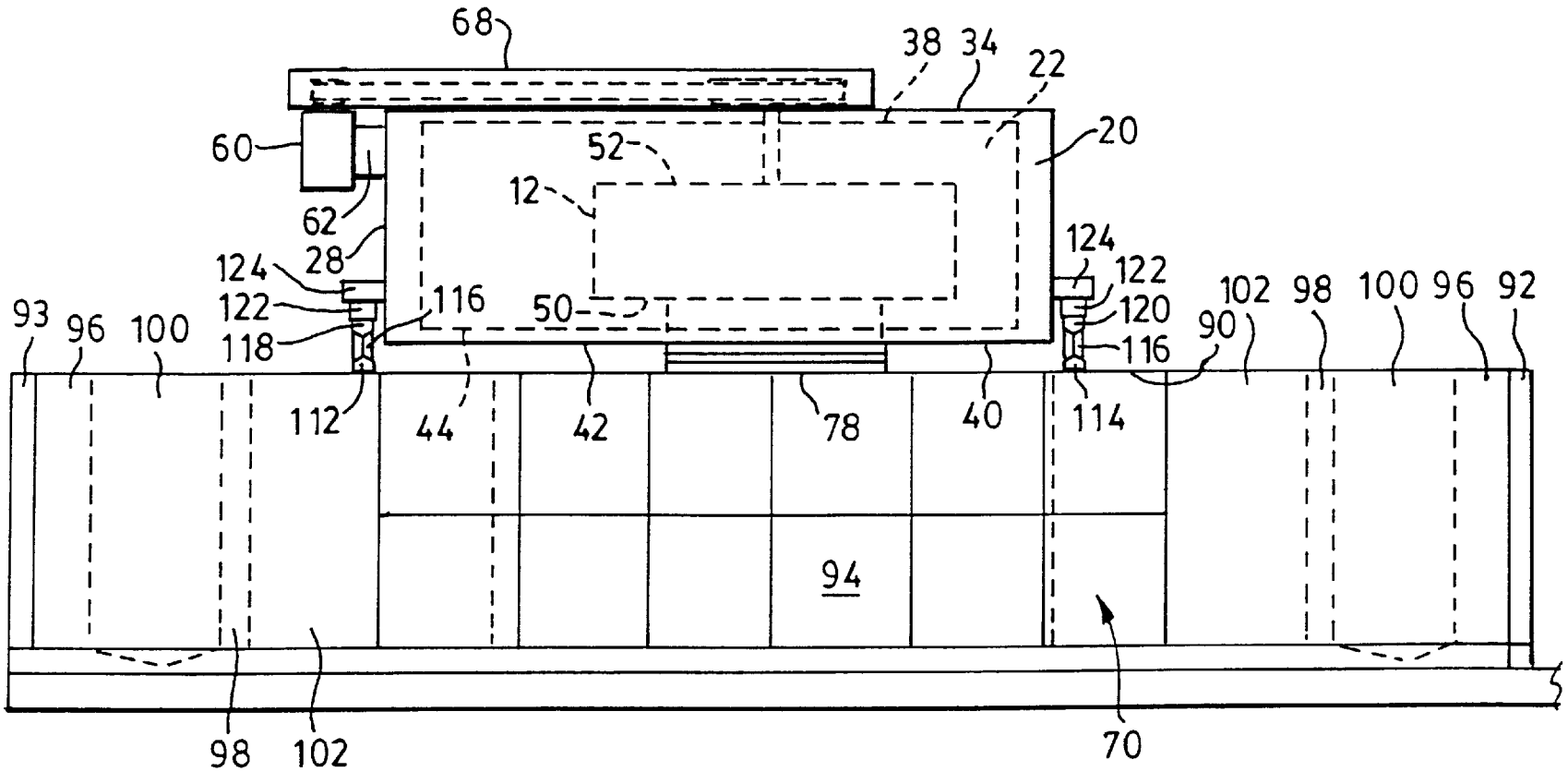
FIG. 2 is a side elevation of a centrifugal fan system constructed in accordance with the invention.
Figure 3:
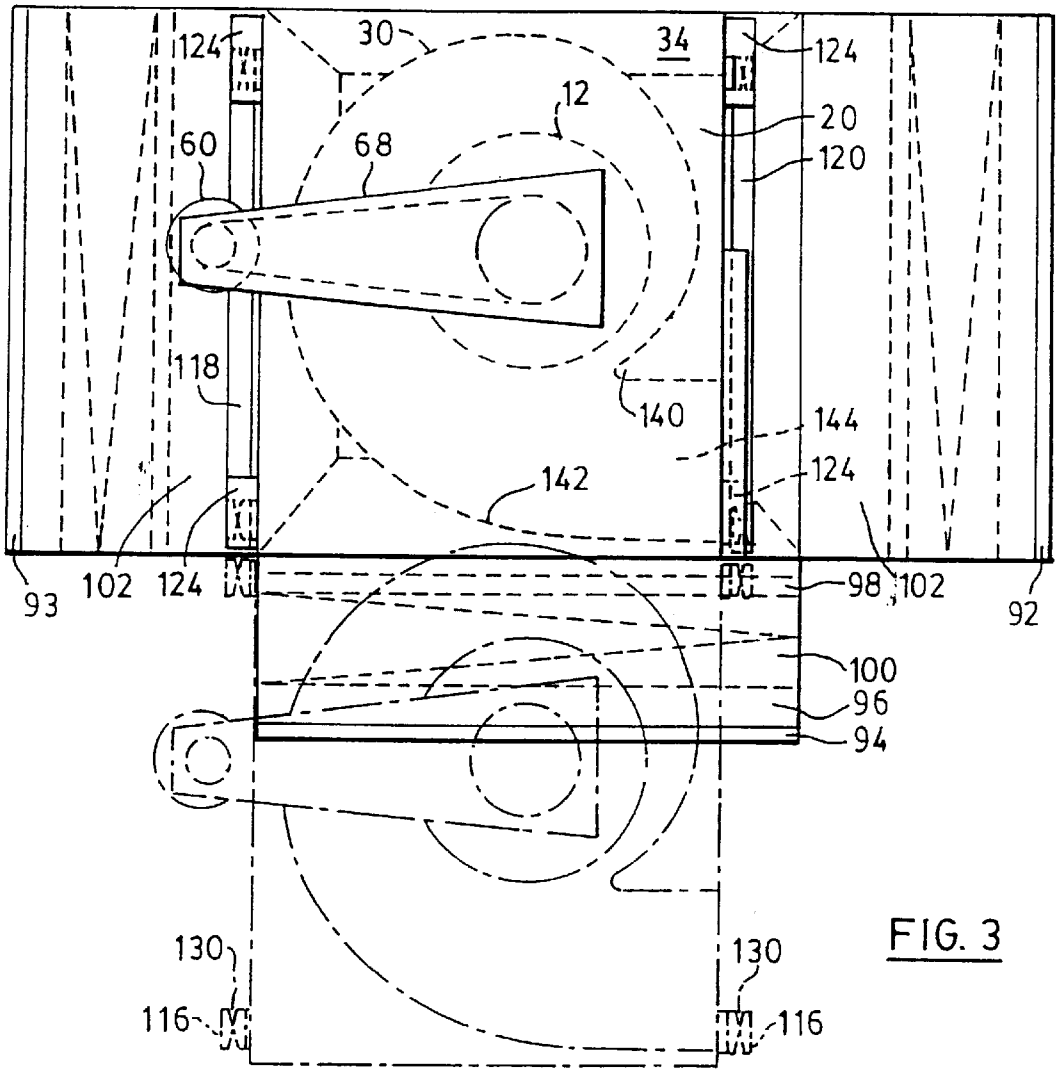
FIG. 3 is a plan view of the fan system of FIG. 2, this view showing the rolled out position of the fan and fan housing in dash lines.

In a manner known per se, the input port of the input silencer can be covered to provide for air filtering and heat exchange, either for heating or cooling or both. The illustrated input silencers of FIGS. 1 to 3 are provided with both filters and heat exchanging units on three vertical sides. It is also possible of course to provide filters and heat exchangers on one, two or all four sides of the input silencer in some installations.

Preferably, rectangular, vertical air filters 92 to 94 are mounted on the outside of the input silencer in a manner known per se. Then, arranged along the inside of these filters are heat exchanging coil units 96 which, in one embodiment, are 10 inches deep and are provided for cooling incoming air. In the version of FIGS. 2 and 3, each of the three sides of the input port is also covered with a heating coil unit 98 in the form of a panel that extends parallel to the filter and the cooling unit. Between the cooling coils 96 and the heating coils 98 is a drain pan section 100. A drain pan is installed downstream of all cooling coils used in the system whether or not heating coils are also used. A transition section 102 is provided between each heating coil unit 98 and the input silencer.

Track and wheel means indicated generally at 110 are provided for movably mounting the combination of the fan housing and the fan. The track means includes two horizontally extending track members 112 and 114 adapted for rigid mounting on a suitable supporting structure. In the illustrated embodiment, this supporting structure includes the top wall 90 of the input silencer 70. The track members can comprise steel rails which extend not only across the top of the input silencer but also outwardly from the top of the silencer as shown in part in FIG. 1. It will be understood that the track members are sufficiently long to permit the fan housing in the fan to be moved horizontally to a position to one side of the input silencer, thus permitting ready access to the interior of both the silencer and the fan housing. Extension of the track members beyond the top of the input silencer can be achieved (if desired or needed) by the use of removable rail extensions and not necessarily by constructing permanent rail extensions. This may be required from time to time for repairs or maintenance, for example. A number of rotatable wheels 116 which are in rolling engagement with the track members 112, 114, are mounted on the fan housing 20 and support same. In the illustrated preferred embodiment, there are four such wheels mounted on elongate support members 118, 120. In order to reduce vibration effects and the sound caused thereby, coil spring vibration isolators 122 are used to mount the support members 118 and 120 to the side of the fan housing. These isolators can be connected at their top end to an outwardly projecting support bar 124 located at each corner of the housing.

The wheels or casters 116 can take a variety of forms but, in one preferred embodiment, these wheels have annular grooves shown at 130 in FIG. 3 to engage the track members or rails which can have an inverted V-shaped top section 132. It will be understood that the track members 112, 114 are parallel and are as horizontal as possible, thus making it quite easy to move the centrifugal fan and its housing, when required. Preferably, a suitable standard latch mechanism or other connector (not shown) is used to ensure that the fan and its housing remain in place during operation. The latch mechanism is disconnected when it is necessary to move the fan and its housing from the operating position. It will be understood that where the rails or track members project beyond the top of the input silencer, a suitable supporting structure (not shown) is provided to rigidly and firmly support the track members.

In a preferred embodiment, there are four of the vibration isolator springs 122. It will be understood that vibrations can be caused by rotation of the centrifugal fan during operation thereof and the springs act to isolate these vibrations to the fan housing since the springs are the only members connecting the fan housing to the track and wheel means 110.

FIG. 3 illustrates the full extent of the scroll-shaped wall 30. It will be understood that a portion of this wall has been deleted from FIG. 1 for clarity of illustration. As shown in FIG. 3, the scroll commences at the location 140 which is close to the perimeter of the centrifugal fan 12. The curve of the scroll then extends through more than 300 degrees to at least the point indicated at 142 where a straight outlet passageway 144 commences. The passage 144 is still located within the fan housing. The extent of the scroll-shaped wall 30 contributes both to the efficiency of the fan system and to its quiet operation.

Figure 5:
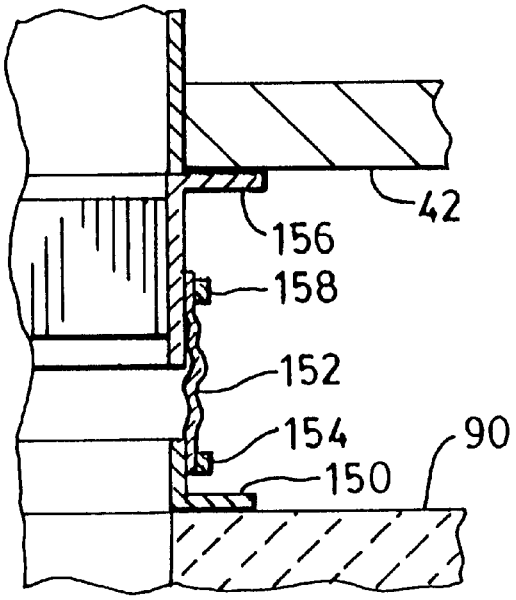
FIG. 5 is a detail view in cross-section showing further details of the flexible connection at the bottom end of the inlet opening.

Shown in FIG. 4 is the manner in which the cylindrical extension 48 can be detachably connected to the concentrator/silencer 70. FIG. 4 also illustrates an alternative construction for rotatably mounting the fan in its housing. In particular, the extension 48 is connected to an annular angle flange 150 that is connected to the top wall 90 of the input silencer. An annular, flexible connector 152 is mounted on the angle flange 150. In one preferred embodiment, the connector is made of neoprene rubber having a thickness of ⅛th inch but other flexible materials can also be used for this connector. A clamp in the form of a steel band 154 can be used to detachably connect the bottom edge of the connector 152 to the angle flange 150. Extending downwardly from the bottom of the fan housing is annular angle member 156 shown in greater detail in FIG. 5. The angle member 156 can be bolted or welded to external panel 42 of the housing. Another clamp 158 in the form of a steel band detachably connects the upper edge of the connector 152 to the angle member 156. Preferably, both clamps 154 and 158 create an air-tight connection.

FIG. 4 illustrates an alternative way of mounting the shaft 14 for the fan. In this embodiment, there is a single thrust bearing 160 mounted in the top wall of the fan housing and another thrust bearing 162 mounted below the fan in the center of the air inlet. Four radial struts in the form of rods 164 can be used to centrally support the bearing 162. These rods are connected to the cylindrical extension 48 which can include the angle member 156. Tapered thrust bearings should be used to rotatably mount the shaft so that the bearings can support the weight of the fan and the shaft.

It will be appreciated by those skilled in the use of fan systems that the fan system described herein, due to the stacked arrangement of the input silencer and the fan and fan housing, minimizes the footprint of the fan system while still providing a unit which is not unduly high. One preferred embodiment of this system which has a capacity of 70,000 cfm can fit within a space approximately 23 feet long, 16 feet wide and 10 feet high, this system including the filters, coils, fan, flow concentrator and fan housing. This preferred unit has a system static pressure of 2.8 inches WG and a fan BHP of 47. Indicated below in Table 1 are the sound level characteristics as measured at three locations on this fan system.

TABLE 1

| ACOUSTICAL MEASUREMENT | MEASURED INSERTION LOSS OCTAVE BANDS | | | | | | | |
|---|---|---|---|---|---|---|---|---|
| LOCATION | 1 | 2 | 3 | 4 | 5 | 6 | 7 | 8 |
| Inlet | 9 | 11 | 15 | 23 | 24 | 25 | 28 | 34 |
| Casing | 11 | 20 | 22 | 25 | 23 | 23 | 19 | 10 |
| Outlet | 9 | 14 | 18 | 20 | 22 | 19 | 17 | 13 |

The sound pressure level was measured at 67 dB(A) at 6 inches distance from the filters.

It will be appreciated by those skilled in fan systems that various modifications and changes can be made to the fan system of this invention without departing from the spirit and scope of this invention. Accordingly, all such modifications and changes as fall within the scope of the appended claims are intended to be part of this invention.

We claim:

1. A centrifugal fan system for a building or other large structure, said system comprising:

an input flow concentrator and integral silencer having a concentrator input port and sidewalls establishing an airflow path from said input port to an output port having an output axis, said airflow path changing from a substantially radial airflow path at said input port to a substantially vertical and axial airflow path at said output port, said input flow concentrator and integral silencer including inner and outer silencer sections, which are coaxial with said output axis and are formed at least partially by said sidewalls, and wherein said sidewalls include a generally conical sidewall forming an upper surface of said inner silencer section;

a centrifugal fan mounted for rotation about a substantially vertical axis which is coaxial with said output port, said fan having a bottom inlet which, during use of said fan, is aligned with said output port;

a linearly movable fan housing having a scroll-shaped fan chamber in which said fan is rotatably mounted and an air outlet arranged in a side thereof;

track and wheel means for movably mounting the combination of said fan housing and said fan, said track means including horizontally extending track members adapted for rigid mounting on a supporting structure and rotatable wheels in rolling engagement with said track members, said wheels being mounted on said fan housing, wherein said fan and fan housing can be moved linearly and horizontally along said track members and away from a top of said input flow concentrator and integral silencer when required.

2. A centrifugal fan system according to claim 1 including motor means for rotating said centrifugal fan, said motor means being mounted on said fan housing and movable therewith along said track members.

3. A centrifugal fan system according to claim 2 wherein said fan housing has an internal, perforated scroll-shaped wall defining said fan chamber, vertically extending external walls surrounding said scroll-shaped wall, and sound insulating material arranged between said scroll-shaped wall and said external walls.

4. A centrifugal fan system according to claim 3 wherein said fan housing includes a horizontally extending top wall which defines a top of said fan chamber and is rigidly connected to said vertically extending external walls and wherein said motor means includes a vertical drive shaft connected to said fan and extending through said top wall.

5. A centrifugal fan system for a building or other large structure said system comprising:

an input flow concentrator and integral silencer having a concentrator input port and sidewalls establishing an airflow path from said input port to an output port having an output axis, said airflow path changing from a substantially radial airflow path at said input port to a substantially vertical and axial airflow path at said output port, said input flow concentrator and integral silencer including inner and outer silencer sections, which are coaxial with said output axis and are formed at least partially by said sidewalls, and wherein said sidewalls include a generally conical sidewall forming an upper surface of said inner silencer section;

a centrifugal fan mounted for rotation about a substantially vertical axis which is coaxial with said output port, said fan having a bottom inlet which, during use of said fan, is aligned with said output port;

a movable fan housing having a fan chamber in which said fan is rotatably mounted and an air outlet arranged in a side thereof;

track and wheel means for movably mounting the combination of said fan housing and said fan, said track means including horizontally extending track members adapted for rigid mounting on a supporting structure and rotatable wheels in rolling engagement with said track members, said wheels being mounted on said fan housing, wherein said fan and fan housing can be moved horizontally along said track members and away from a top of said input flow concentrator and integral silencer when required.

6. A centrifugal fan system according to claim 1 wherein said outer silencer section is an annulus and defines said output port, said annulus around its circumference being substantially semi-circular in transverse cross-section, one of said sidewalls forming a rounded bottom and vertical sides of said annulus.

7. A centrifugal fan system according to claim 6 including motor means for rotating said centrifugal fan, said motor means being mounted on said fan housing and movable therewith along said track members.

8. A centrifugal fan system according to claim 6 wherein said fan housing has an internal, perforated scroll-shaped wall defining said fan chamber, vertically extending external walls surrounding said scroll-shaped wall, and sound insulating material arranged between said scroll-shaped wall and said external walls.

9. A centrifugal fan system according to claim 6 wherein the input port of said input flow concentrator and integral silencer is provided on three vertical sides of the concentrator and integral silencer and said three vertical sides are covered by filters and heat exchanging coil units so that air flowing into the concentrator and integral silencer during use of the fan system first passes through the filters and coil units.

10. A centrifugal fan system according to claim 1 wherein said fan housing is mounted on support members by means of coil spring vibration isolators and said wheels are rotatably mounted on said support members.

11. A centrifugal fan apparatus for a building or other large structure, said fan comprising:

an input flow concentrator having a concentration input port and sidewalls establishing an airflow path from said input port to an output port having an output axis, said airflow path changing from a substantially radial airflow path at said input port to a substantially vertical and axial airflow path at said output port;

a linearly movable fan housing having a fan chamber and an air outlet in a vertical sidewall thereof said fan housing having a scroll-shaped wall defining said fan chamber and being mounted above said flow concentrator during use thereof;

a centrifugal fan member mounted in said housing for rotation in said fan chamber about a substantially vertical axis, said fan member having a number of blades and a bottom air inlet;

wheels rotatably mounted on said fan housing and supporting said fan housing and fan member; and track means for guiding linear horizontal movement of said fan housing and fan member and for supporting same, said track means including track members adapted for mounting in a fixed position on a supporting structure, wherein said wheels are adapted for rolling engagement with said track means so that said fan housing and fan member can be moved horizontally from an operating position, when required.

12. A centrifugal fan according to claim 11 including electrical motor means for rotating said centrifugal fan member, said motor means being mounted on said fan housing and movable therewith along said track members.

13. A centrifugal fan according to claim 11 wherein said scroll-shaped wall defining said fan chamber is an internal perforated wall, vertically extending external walls surround said scroll-shaped wall, and sound insulating material is arranged between said scroll-shaped wall and said external wall.

14. A centrifugal fan according to claim 13 wherein said fan housing includes horizontally extending, insulated top and bottom walls which define a top and a bottom of said fan chamber, said bottom wall having a centrally located air inlet opening aligned with said bottom air inlet of the fan member.

15. A centrifugal fan member according to claim 13 wherein said fan housing is mounted on support members by means of spring vibration isolators and said wheels are rotatably mounted on said support members.

16. A centrifugal fan unit for supplying relatively large quantities of air to a building or other large structure, said fan unit comprising:

an input flow concentrator having a concentrator input port and sidewalls establishing an airflow path from said input port to an output port having an output axis, said airflow path changing from a substantially radial airflow path at said input port to a substantially vertical and axial airflow path at said output port;

a linearly movable fan housing mounted above said flow concentrator and having a fan chamber and an air outlet in a vertically extending sidewall thereof, said housing including an internal, perforated, scroll-shaped wall defining a vertically extending peripheral wall of said chamber and including vertically extending external walls arranged around said scroll-shaped wall, sound insulating material being located along an outer surface of the scroll-shaped wall between said scroll-shaped wall and said external walls, a centrifugal fan member mounted in said housing for rotation in said fan chamber about a substantially vertical axis, said fan member having a number of blades and a bottom air inlet, and wheels operatively associated with said fan housing and supporting said fan housing and said fan member, wherein said substantially vertical axis of the fan member and said output axis are substantially coaxial.

17. A centrifugal fan unit according to claim 16 wherein said fan housing has an insulated top wall covering a top of said fan chamber, said top wall being rigidly attached to said scroll-shaped wall and said vertically extending external walls.

18. A centrifugal fan unit according to claim 17 wherein said fan housing includes a bottom wall defining a bottom of said fan chamber, said bottom wall having a central opening formed therein which is aligned with said bottom air inlet of said fan member.

19. A centrifugal fan unit according to claim 18 including electrical motor means for rotating said fan member, said motor means being mounted on said fan housing and including a vertical drive shaft that extends through said top wall to said fan member.

20. A centrifugal fan unit according to claim 17 including wheel means for moving both the fan housing and the fan member horizontally when required, said wheel means being mounted on opposite sides of fan housing.

21. A centrifugal fan unit according to claim 16 wherein said input flow concentrator is also an integral silencer containing sound insulating material.

* * * * *